US005448026A

United States Patent [19]

Ozeki et al.

[11] Patent Number: 5,448,026

[45] Date of Patent: Sep. 5, 1995

[54] DOUBLE-AXIS KEY SWITCH

[75] Inventors: Kumio Ozeki; Fumio Watanabe; Haruo Yoshida; Yosuke Sakai, all of Tokyo, Japan

[73] Assignee: SMK Corporation, Tokyo, Japan

[21] Appl. No.: 161,222

[22] Filed: Dec. 2, 1993

[30] Foreign Application Priority Data

Dec. 2, 1992 [JP] Japan ..... 4-089506 U

[51] Int. Cl.[6] ..... H01H 13/70

[52] U.S. Cl. ..... 200/5 A; 200/517; 200/341; 200/276.1

[58] Field of Search ..... 200/5 A, 5 R, 512–517, 200/341–345, 276, 276.1; 235/145 R

[56] References Cited

U.S. PATENT DOCUMENTS 3,916,150 10/1975 Abertheny et al. ..... 200/345
4,559,427 12/1985 Dolson et al. ..... 200/5 A X
4,574,171 3/1986 Denley ..... 200/344
4,806,908 2/1989 Krupnik ..... 200/5 R X
4,927,990 5/1990 Aoki et al. ..... 200/517
5,145,058 9/1992 Lee ..... 200/517
5,204,511 4/1993 Baitz et al. ..... 235/145 R
5,306,886 4/1994 Yamada ..... 200/5 A X

*Primary Examiner*—J. R. Scott
*Attorney, Agent, or Firm*—Mark Catan; Thomas R. Morrison

[57] ABSTRACT

A double-axis key switch has a key cap with a pair of key stems which slide into a housing to actuate a pair of switches. The key stems are slightly out of parallel so that the axes of the key stems meet in a direction of stroke relative to the key cap. However, the sleeves, into which the key stems insert, are parallel. When the key cap is pressed off-center, causing tilting of the key cap, one key stem advances ahead of the other. Because of the relative positions of the axes, binding forces increase in the leading key stem and decrease in the following stem. The asymmetry of the binding forces tends to correct the tilting of the key cap so that the key cap advances symmetrically and smoothly.

11 Claims, 5 Drawing Sheets

Prior Art

DOUBLE-AXIS KEY SWITCH

BACKGROUND OF THE INVENTION

This invention relates to double-axis (2×1 unit) type key switches for use in key input devices, for example point of sale terminals or electronic cash registers.

Referring to FIG. 4, a typical conventional double-axis key switch 100 for a key input device includes a single piece housing 10 with two key stem guide sleeves 12, 12. Each of a pair of key stems 14, 14 fits slidably into a respective one of key stem guide sleeves 12, 12. Key stems 14, 14 slide downward when a key cap 16 is pressed. When key cap 16 is pressed, tips of coil springs 18, 18 that are set inside key stems 14, 14 are moved toward stationary contacts 24, 24 and 24, 24 on a printed wiring board 20 in housing 10. The tip of each coil spring 18 closes a switch by making electrical contact with a respective pair of stationary contacts 24, 24.

Double-axis key switch 100 is susceptible to the following problem when a downward force F is applied to a position away from a center point between key stems 14, 14. The key stems 14, 14 bind in their respective key stem guide sleeves 12, 12 due to friction between each key stem 14 and an inside surface at a mouth of a respective key stem guide sleeve 12. The force of this binding makes it difficult to operate double-axis key switch 100. Key stems 14, 14 may therefore fail to slide downwardly.

A known prior art, method for eliminating this problem is to use a connecting rod to connect one key stem 14 with the other. The connecting rod maintains the two key stems at the same height throughout the downward movement. The binding is thus prevented by preventing the tilting of the key stems 14, 14.

Another method of eliminating the binding problem is to use a dummy key connected to the same key cap to help guide the key stems.

The inclusion of the connecting rod increases the number of manufacturing steps as well as the number of constituent parts. These, in turn, lead to an increase in cost. The key board switch employing the dummy switch configuration also involves an inefficient utilization of the key board surface area, resulting, ultimately, in a higher cost.

OBJECTS AND SUMMARY OF THE INVENTION

It is an object of the present invention to provide a double-axis key switch that overcomes the drawbacks of the prior art.

It is further object of the present invention to provide a double-axis key switch that permits free, non-binding, upward and downward movement of a key cap of said key switch.

It is still another object of the present invention to provide a double-axis key switch that is economical to manufacture.

It is still another object of the present invention to provide a double-axis key switch that contributes little to the cost of keyboard assemblies, permitting such keyboard assemblies to be low in cost.

It is still another object of the present invention to provide a double-axis key switch that may be converted easily and inexpensively to a single-axis type key switch.

Briefly stated, there is disclosed, a double-axis key switch having a key cap with a pair of key stems which slide into a housing to actuate a pair of switches. The key stems are slightly out of parallel so that the axes of the key stems meet in a direction of stroke relative to the key cap. However, the sleeves, into which the key stems insert, are parallel. When the key cap is pressed off-center, thus tending to tilt the key cap, one key stem advances ahead of the other. Because of the relative positions of the axes, binding forces increase in the leading key stem and decrease in the following stem. The asymmetry of the binding forces tends to correct the tilting of the key cap so that the key cap advances symmetrically and smoothly.

According to an embodiment of the present invention, there is disclosed, a double-axis key switch, comprising: a key cap, two key stems connected to the key cap, each having an axis lying substantially in a first plane, a housing having two key stem guide sleeves, each having an axis lying substantially in the first plane, each of the two key stems being slidably inserted in a respective one of the two key stem guide sleeves and nearly coaxial with the respective one, whereby the key cap and the two key stems are free to slide down toward the housing in a direction of stroke and return up again in a direction opposite the direction of stroke, means for actuating switches when the key cap is stroked in the direction of stroke, a one of the two key stem axes forming a first angle with respect to a second plane, the second plane being perpendicular to the first plane and parallel to the direction of stroke, the two key stem guide sleeve axes being parallel to the second plane, the other of the two key stem axes forming a second angle with respect to the second plane and the second angle being approximately equal in magnitude, and opposite in direction, with respect to the second plane, such that the two key stem axes cross far from the key cap in the direction of stroke relative to the key cap.

According to another embodiment of the present invention, there is disclosed, a double-axis key switch, comprising: a key cap having two shafts, each having an axis lying in a first plane, each of the two shaft axes forming equal and opposite angles with respect to a second plane, the second plane being perpendicular to the first plane, the two shaft axes crossing in a direction of stroke relative to the key cap, a housing having two key stem guide sleeves, each having an axis lying in the first plane and parallel to the second plane, two key stems, each slidably inserted in a respective one of the two key stem guide sleeves, the key cap being rigidly connected to the two key stems by inserting each of the two shafts into a recess in a respective one of the two key stems and a shifting of the two key stems in the direction of stroke actuating the key switch by pressing a member connected to at least one of the two key stems against a switch element in the housing.

According to still another embodiment of the present invention, there is disclosed, a double-axis key switch, comprising: a housing with two integral key stem guide sleeves, two key stems slidably inserted in the key stem guide sleeves, a key cap connected to the two key stems, at least one switch connected to the housing, the at least one being actuated by shifting the two key stems downward by pressing the key cap, whereby the two key stems are shifted in a downward direction, center axes of the two key stems forming an acute angle, the angle having a vertex located away from the housing in the downward direction relative to the housing, a bisector of the angle being parallel to the downward direction and axes of the key stem guide sleeves being parallel to the downward direction.

According to still another embodiment of the present invention, there is disclosed, a double-axis key switch, comprising: a key cap having two shafts, each having an axis lying in a first plane, each of the two shaft axes being parallel to a second plane, the second plane being perpendicular to the first plane, a housing having two key stem guide sleeves, each having an axis lying in the first plane, the two key stem guide sleeve axes forming equal and opposite angles with respect to the second plane, the two key stem guide sleeve axes crossing in a direction opposite to a direction of stroke relative to the key cap, two key stems, each slidably inserted in a respective one of the two key stem guide sleeves, the key cap being rigidly connected to the two key stems by inserting each of the two shafts into a recess in a respective one of the two key stems and a shifting of the two key stems in the direction of stroke actuating the key switch by pressing a member connected to at least one of the two key stems against a switch element in the housing.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
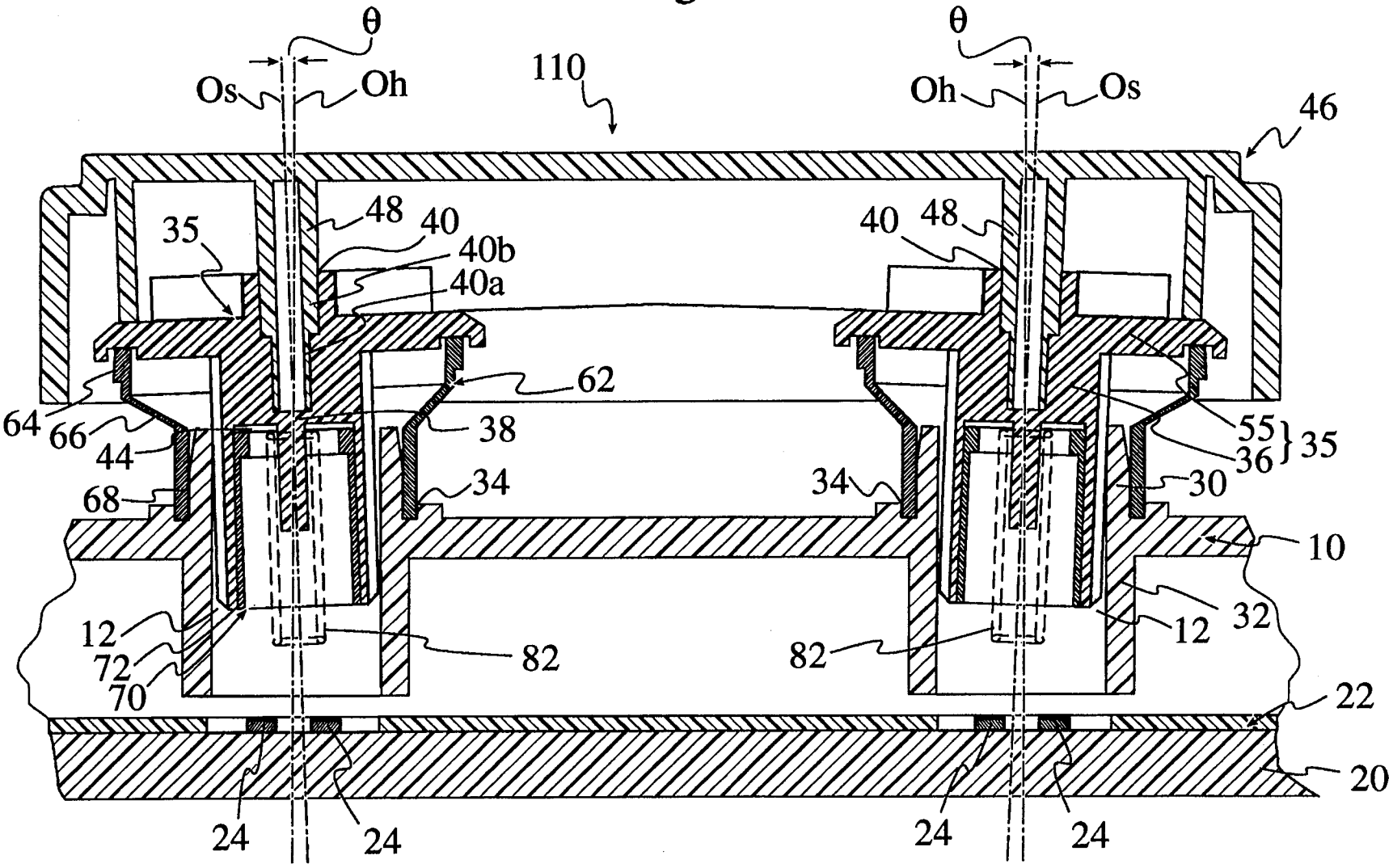
FIG. 1 is a front cross-sectional view of the double-axis key board switch according to an embodiment of the present invention.
Figure 2:
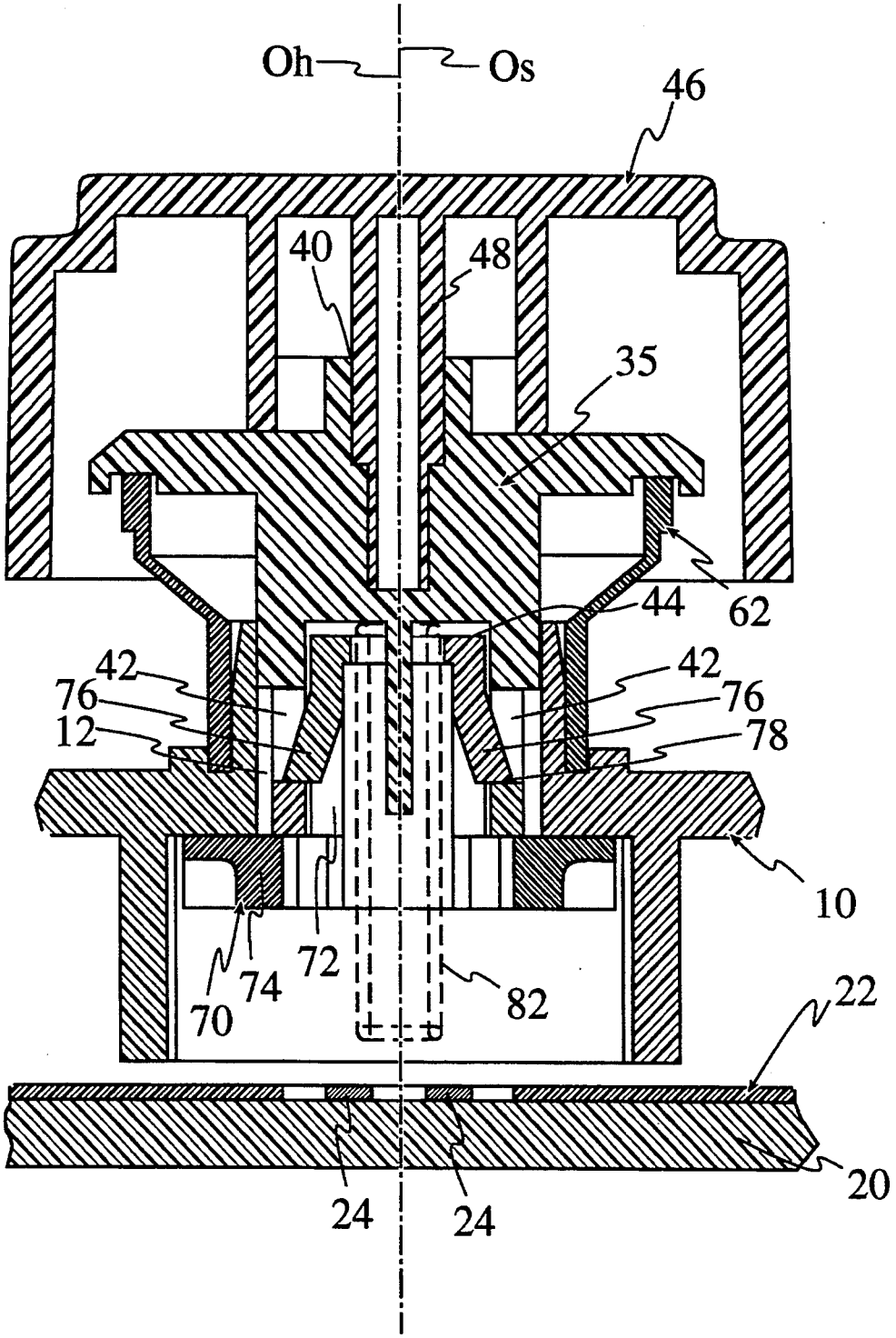
FIG. 2 is a side cross-sectional view of the double-axis key switch of FIG. 1.

Referring to FIGS. 1 and 2, a double-axis key switch 110 has a housing 10, of molded synthetic resin, with integral key stem guide sleeves 12, 12. Each key stem guide sleeve 12 consists of an upper guide sleeve 30, which extends above housing 10, and a lower guide sleeve 32, extending down through housing 10. A lower annular groove 34 encircles the outside of upper guide sleeve 30 at its base.

Each of a pair of key stems 35, 35 of molded synthetic resin, includes a sliding member 36, which is roughly cylindrical in shape. Each sliding member 36 is slidably inserted in a respective key stem guide sleeve 12. Each key stem 35 has an integral key cap support 55. Each key cap support 55 has a wide integral flange projecting radially from an upper periphery of the respective sliding member 36. A barrier 38 lies at an upper end of an upper cavity of each sliding member 36.

Each barrier 38 is located near the center of its respective sliding member 36, partitioning an upper cavity 40 and a lower cavity 44. Each lower cavity 44 includes windows 42, 42. Each upper cavity 40 is composed of a first cavity 40*a* and a second cavity 4*b*. First cavity 40*a* has a square cross section and is contiguous with, and below, second cavity 40*b*. The second cavity has a circular cross section with a greater cross-sectional area than the first cavity.

A key cap 46 of molded synthetic resin, has integral shouldered shafts 48, 48 projecting downward from a bottom surface of key cap 46. Each shouldered shaft 48 is press-fitted into upper cavity 40 of a respective one of sliding members 36, 36. As shown in FIG. 1, the center axes Os, Os of shouldered shafts 48, 48 are not parallel. A very small angle $\theta$ (approximately one degree in the present embodiment) separates center axes Oh, Oh of key stem guide sleeves 12, 12 and axes of shouldered shafts Os, Os. The angle between either center axis Oh and one center axis Os is equal, and opposite, the angle between either center axis Oh and the other center axis Os. In other words, the center axes Os, Os are further apart near key cap 46 than near housing 10. Put still another way, center axes Os cross at a location far from key cap 46 in the direction going from key cap 46 toward housing 10. Note that center axes Oh, Oh are parallel to each other. When shouldered shafts 48, 48 are inserted in upper cavities 40, 40 in sliding members 36, 36, the center axes of key stems 35, 35 are tilted. Thus, center axes Os, Os of shouldered shafts 48, 48 and those of key stems 35, 35 coincide.

Each of a pair of boots 62, 62 is made of elastic material such as synthetic rubber. Each boot 62 has a large-diameter cylindrical end portion 64. Each large-diameter cylindrical end portion 64 is contiguous with a tapering cylindrical middle portion 66. Each tapering cylindrical middle portion 66 is contiguous with a small-diameter cylindrical end portion 68. An upper annular groove 58 encircles the base of each shouldered-shaft on the bottom of key cap support 55. Each large-diameter cylindrical end portion 64 is inserted in a respective one of upper annular grooves 58, 58. An edge of each small-diameter cylindrical end portion 68 is inserted in a respective one of lower annular grooves 34, 34. At the same time, each small-diameter cylindrical end portion 68 is slipped snugly over a respective one of upper guide sleeves 30, 30. These insertions and the snug fits, constitute hermetic seals at the ends of boots 62, 62 that prevent dust or water from infiltrating the spaces surrounded by boots 62, 62.

A pair of stoppers 70, 70, each of molded synthetic resin, include hollow cylinders 72, 72. Each hollow cylinder 72 is slidably inserted in lower cavity 44 of a respective one of sliding members 36, 36. Each stopper 70 has an integral stopper base 74 at an end of a respective hollow cylinder 72. Each hollow cylinder 72 incorporates a pair of flaps 76, 76 cut from its wall. A lower end of each flap 76 has stepped edges 78 which engage with a lower edge of a respective one of windows 42, 42. Stopper bases 74, 74 are prevented from rotating by engagement of stopper bases 74, 74 with side walls of lower guide sleeve 32 of housing 10.

Each of a pair of coil springs 82, 82 is held inside hollow cylinder 72 of a respective stopper 70. Each hollow cylinder 72 is held in lower cavity 44 of a respective sliding member 36. A free end of each coil spring 82 hangs over, and close to, a respective pair of stationary contacts 24, 24. Stationary contacts 24, 24 and 24, 24 lie in a flexible printed circuit (FPC) 22. FPC 22 in turn is attached to a printed wiring board (PWB) 20. Stationary contacts 24, 24 and FPC 22 connect to various printed circuits (not shown).

To assemble the embodiment described above, the end of small-diameter cylindrical end portion 68 of each boot 62 is fitted into a corresponding one of lower annular grooves 34, 34 formed around a respective upper guide sleeve 30 of housing 10. Each sliding member 36 is inserted from above into a respective one of key stem guide sleeves 12, 12. An edge of large-diameter cylinder portions 64 of each boot 62 is fitted into a respective one of upper annular grooves 58, 58 of key cap support 55. Each stopper 70 is assembled to the lower end of a respective sliding member 36 by pushing stopper 70 upward toward key cap support 55 until stepped edges 78, 78 of flaps 76, 76 engage lower edges of windows 42, 42.

To assemble key cap 46 to key stems 35, 35, key cap 46 is positioned over shouldered shafts 48, 48 of key cap 46 so that each shouldered shafts 48 lines up beneath a respective cavity 40. Key cap 46 is then forced down so that shouldered shafts 48, 48 are press-fitted into cavities 40, 40 of sliding members 36, 36.

Center axes Os, Os of shouldered shafts 48, 48 are inclined at angles of magnitude $\theta$ with respect to center axes Oh of key stem guide sleeves 12, 12. The angle between one of center axes Os with parallel center axes Oh, Oh is opposite in direction of that of the other center axis Os. Thus, the configuration of the axes of shouldered shafts 48, 48 is bilaterally symmetric. After key cap 46 is fitted to key stems 35, 35, the center axes of key stems 35, 35 coincide with the center axes Os, Os of shouldered shafts 48, 48. Therefore, the center axes of key stems 35, 35 are inclined at angles of magnitude $\theta$ with respect to center axes Oh, Oh of key stem guide sleeves 12, 12. Again, the overall configuration exhibits bilateral symmetry.

The operation of double axis key switch 110 is as follows. Sliding members 36, 36 of key stems 35, 35 shift down when key cap 46 is depressed. Coil springs 82, 82 are also carried down so that their lower ends touch stationary contacts 24, 24 and 24, 24 on FPC 22. The touching results in closure of stationary contacts 24, 24 and 24, 24, actuating the switches. Boots 62, 62 are elastically deformed as sliding members 36, 36 move downward. Tapering cylinder portions 66, 66 of boots 62, 62 buckle when the pressing force applied to key cap 46 exceeds a buckling load of tapering cylinder portions 66, 66. Thus, a click-like shock is transmitted to key cap 46. The shock provides a tactile feedback to an operator that confirms actuation. When the pressing force applied to key cap 46 is released, sliding members 36, 36 return to home positions due to restoring forces of buckled boots 62, 62 and compressed coil springs 82, 82.

Figure 3A:
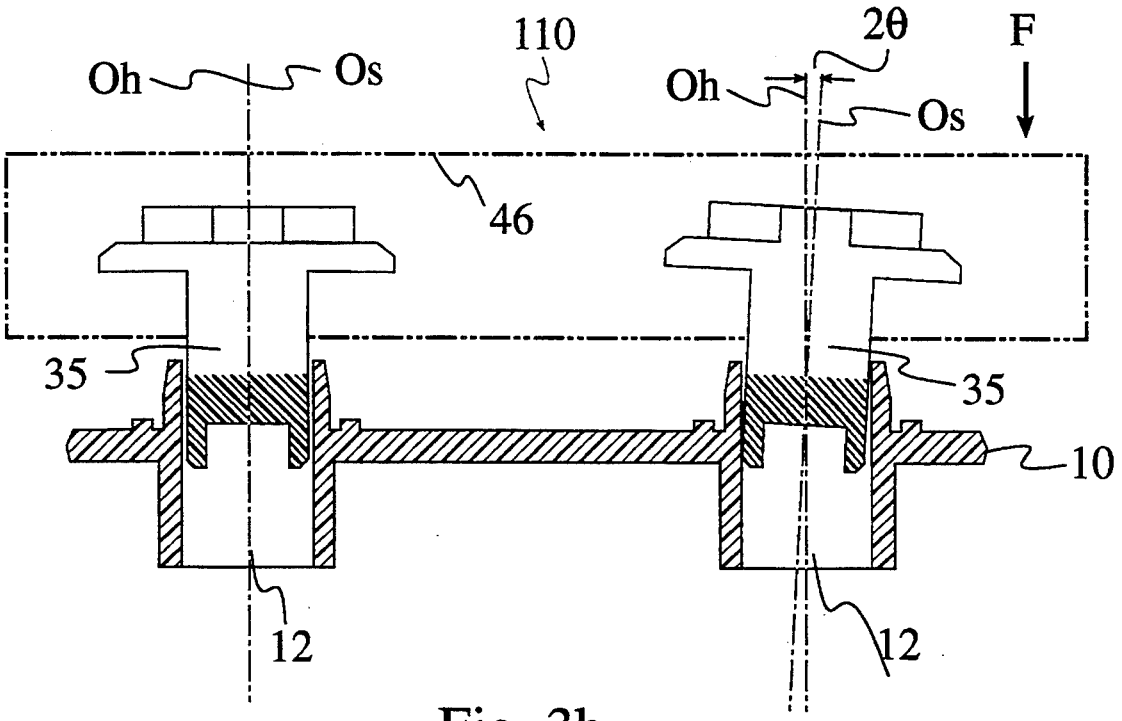
FIG. 3*a* is a front cross-sectional view of the double-axis key board switch of FIG. 1 showing the tilting of a key cap of the switch due to uneven pressure being applied to the key cap at the start of a stroke.
Figure 3B:
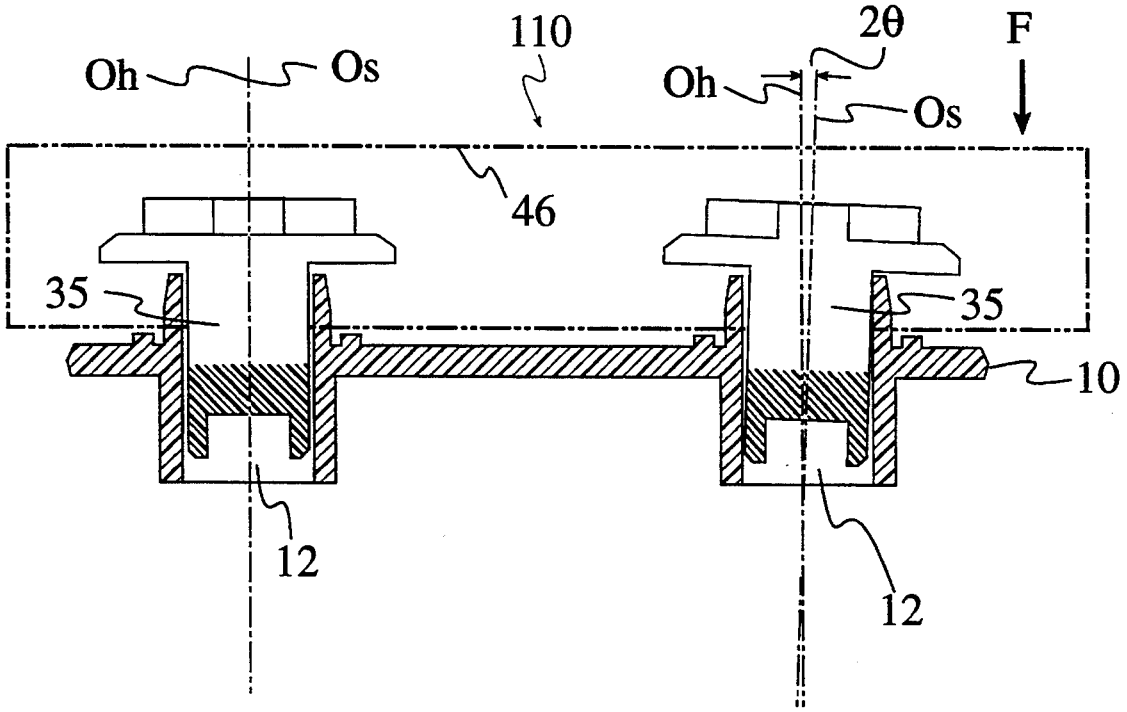
FIG. 3*b* is a front cross-sectional view of a principal portion of the double-axis key board switch of FIG. 1 showing the tilting of a key cap of the switch due to uneven pressure being applied to the key cap at the bottom of a stroke.
Figure 4:
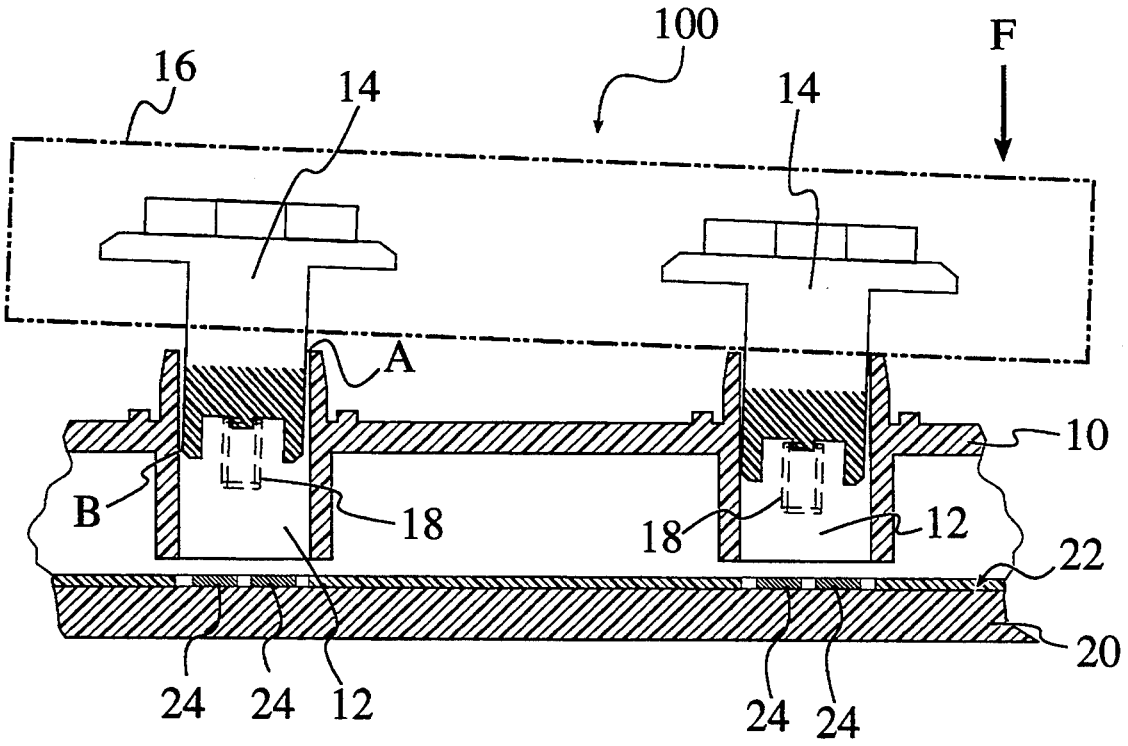
FIG. 4 is a front cross-sectional view of the double-axis key board switch according to the prior art.

Referring to FIGS. 3*a* and 3*b*, the result of a tilting of key cap 46 by an off-center pressing force F is shown. Note that FIGS. 3*a* and 3*b* are simplified views of the configuration shown in FIG. 1. Pressing force F is applied to an off-center point on key cap 46 causing key cap 46 to tilt slightly. Note that both center axes Os, Os of key stems 35, 35 are initially inclined at angle $\theta$ with respect to center axes Oh, Oh of key stem guide sleeves 12, 12. After force F is applied, center axes Os of key stems 35, 35 tilt with key cap 46. This tilting increases the angle between center axes Oh, Oh and center axis Os of the one of key stems 35, 35 that is closest to the point of force application. Simultaneously, the tilting increases the angle between center axes Oh, Oh and center axis Os of the one of key stems 35, 35 farthest from the point of force application. In FIG. 3*a*, the increased angle is shown as $2\theta$ and the decreased angle is shown as zero, assuming, by way of example, that angle $\theta$ doubles when force F is applied.

An increase of the angle between the center axis Os of one of key stems 35, 35 and a respective key stem guide sleeve, 12, increases friction and therefore generates increased binding forces. A decrease of the angle between the center axis Os of one of key stems 35, 35 and a respective key stem guide sleeve, 12, decreases friction and therefore reduces generation of binding forces. As a result, binding forces decrease between the key stem 35 that is more remote from the point of application of force F, and the corresponding key stem guide sleeve 12. Simultaneously, binding forces increase between the key stem 35 that is more proximate to the point of application of force F and corresponding key stem guide sleeve 12. The asymmetry in binding forces tends to correct the tilting of key cap 46. Therefore, if a pressing force F is applied to an off-center point on the top surface of key cap 46, key stems 35, 35 are smoothly shifted down through key stem guide sleeves 12, 12.

Note that according to the above-described embodiment, a key cap and key stems comprise separate elements of a double axis key switch. In addition, two integral shouldered shafts extend from the key cap at inward angles (ie, the distance between the axes decreases in the downward direction). The two shouldered shafts are press-fitted into upper cavities of the key stems to force the center axes of the key stems to incline with respect to the center axes of the corresponding key stem guide sleeves. However, the application of this invention is not confined to this embodiment. The invention can be applied to any structure where the distance between the center axes of two key stems decreases in the direction in which the key is stroked. For example, the invention can be applied to a key switch with a key cap having integral key stems. In that case, the center axes of the two key stems would be inclined with respect to the center axes of the key stem guide sleeves, as in the preferred embodiment.

Note also that the invention may be applied to a configuration where a key cap is rigidly connected to key stems which are parallel and with key stem guide sleeves whose axes cross in a direction opposite to the direction of stroke. In other words, the key stem guide sleeve axes would come together in a direction opposite the direction of stroke. In this case, a key stem opposite to an end of the key cap which is pressed would bind more than the key stem closer to the end of the key cap which is pressed. Thus, the self-rectifying effect for this configuration would be the same as for the configuration described above.

Figure 1A:
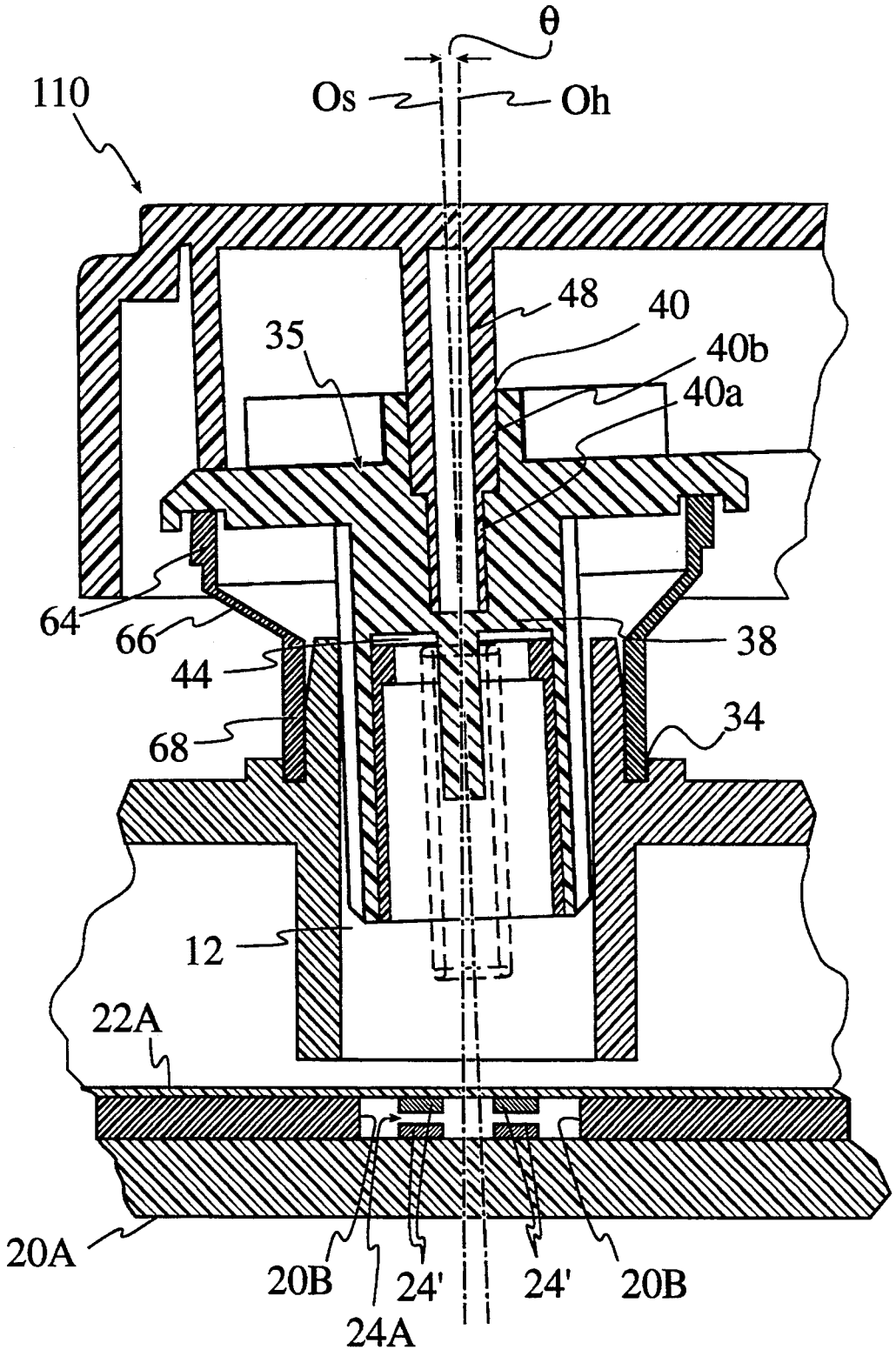
FIG. 1A is a front cross-sectional view of part of a double-axis key board switch according to an alternative embodiment of the present invention.

Note that according to the embodiment of FIG. 1, a double-axis key switch actuates switches by electrically bridging contacts on a FPC on top of a PWB when the ends of springs touch respective contacts. However, the invention is not limited to this embodiment. Referring to FIG. 1A, alternatively, the invention may be applied to a double-axis key switch where actuation is performed by causing the springs to press on membrane switches, one of which is shown at 24A. The membrane switch 24A may be formed by laminating a lower FPC 20A with stationary contacts 24 on its upper surface, a spacer 20B, and an upper FPC 22A with a movable contact 24 on its lower surface. Another alternative is replace the coil springs with a conductive piece of rubber or a conducting rod in place of the spring of the embodiment of FIG. 1.

According to the embodiment of FIG. 1 a double-axis key board switch includes two key stems with center axes inclined at opposite angles with respect to the axes of key stem guide sleeves. The angles formed are such that the distance between the axes of the two key stems decreases in the direction of key stroke. Consequently, if an off-center pressing force is applied to a key cap of the key switch, the key cap tends to become misaligned with respect to housing 10. The key stem remoter from the point of force application makes less frictional contact with its respective key stem guide sleeve. The key stem more proximate to the point of force application makes more frictional contact with its respective key stem guide sleeve. The asymmetry in frictional forces tends to correct the misalignment. The sliding performance of the key stems can be improved without using a separate connecting rod as required in the prior art double-axis key switch 100. Also, the present invention avoids the need for a dummy switch to guide key travel.

The present invention eliminates the binding problem of the prior art. The invention provides a double-axis key switch, with bind-free sliding performance, without increasing the number of constituent parts. In addition, the invention permits the double-axis key switch to be converted to a single axis-type ($1\times1$ unit) key switch by simply exchanging a double-type key cap for two single-type key caps.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A double-axis key switch, comprising:

a key cap;

two key stems connected to said key cap, each having an axis lying substantially in a first plane;

said first plane being parallel to a direction of stroke;

a housing having two key stem guide sleeves, each having an axis lying substantially in said first plane;

each of said two key stems being slidably inserted in a respective one of said two key stem guide sleeves whereby said key cap and said two key stems are free to slide down toward said housing in said direction of stroke and to return up again in a direction opposite said direction of stroke;

means for actuating a switch when said key cap slides down in said direction of stroke;

said two key stem axes forming first and second angles, respectively, with a second plane;

said second plane being perpendicular to said first plane and parallel to said direction of stroke;

said two key stem guide sleeve axes being parallel to said second plane; and said second angle being approximately equal in magnitude, and opposite in direction with respect to said second plane, to said first angle such that said two key stem axes cross far from said key cap in said direction of stroke relative to said key cap.

2. Apparatus as in claim 1, wherein:

said switch is one of two switches; and each of said two key stems includes means for actuating a respective one of said two switches when said key cap slides toward said housing.

3. Apparatus as in claim 1, wherein:

said two key stems are integral with said key cap; and said key cap is of molded synthetic resin.

4. Apparatus as in claim 1, wherein:

each of said two key stems is encased by a boot of flexible material; and said boot is hermetically sealed at a top thereof to a respective one of said two key stems and at a bottom thereof to said housing, whereby said one is protected from infiltration by dust and moisture.

5. Apparatus as in claim 1, wherein:

each of said two key stems is encased by a boot of elastic material such that said boot buckles when said two key stems slide in said direction of stroke; and said boot includes means for generating a restoring force tending to return said key cap to a home position when said boot is buckled.

6. Apparatus as in claim 1, wherein said switches are membrane switches, each comprising:

a flexible printed circuit on top of a spacer;

said spacer lying on top of a printed wiring board;

a movable contact attached to said flexible printed circuit;

a stationary contact attached to said printed wiring board; and means for actuating each of said switches by pressing on said flexible printed circuit to cause said movable contact to touch said stationary contact.

7. A multi-axis key switch, comprising:

a key cap having first and second key stems attached thereto;

a key housing having first and second key stem guide sleeves for slidably receiving said first and second key stems, respectively;

said first and second key stems being inserted in said first and second key stem guide sleeves, whereby said first and second key stems are free to slide within said first and second key stem guide sleeves;

said first key stem having means for frictionally binding in said first key stem guide sleeve when said second key stem is tilted in a first direction beyond a first angle relative to said housing;

said second key stem having means for frictionally binding in said second key stem guide sleeve when said second key stem is tilted in a second direction beyond a second angle relative to said housing;

said first direction being substantially opposite said second direction; and said first and second key stems being arranged, relative to each other, such that, when said key cap is tilted in said first direction up to said first angle, said second key stem rotates away from said second angle, and, when said key cap is tilted in said second direction up to said second angle, said first key stem rotates away from said first angle.

8. A key switch, comprising:

a key cap having first and second key stems connected thereto;

a housing having first and second key stem guides for slidably receiving said first and second key stems, respectively;

said first key stem guide including first means for preventing tilting of said key cap in a first direction away from an untilted position of said key cap beyond a first angle with respect to said untilted position;

said first means for preventing being effective to generate a first binding frictional force between said first key stem guide and said first key stem which force inhibits free sliding movement of said first key stem in said first key stem guide when said key cap is forcibly tilted beyond said first angle;

said second key stem guide including second means for preventing tilting of said key cap in a second direction, generally opposite said first direction, from said untilted position beyond a second angle with respect to said untilted position;

said second means for preventing being effective to generate a second binding frictional force between said second key stem guide and said second key stem force which force inhibits free sliding movement of said second key stem in said second key stem guide when said key cap is forcibly tilted beyond said second angle;

said first and second directions being generally opposite;

said first and second key stems being tilted relative to each other such that, when said key cap is tilted in said first direction and beyond said first angle, said key cap tilts away from said second angle, whereby said first binding frictional force is generated and said second binding frictional force is not generated, and, when said key cap is tilted in said second direction and beyond said second angle, said key cap tilts away from said first angle, whereby said second binding frictional force is generated and said first binding frictional force is not generated.

9. A double-axis key switch, comprising:

a key cap;

a housing;

one of said key cap and said housing having two key stems;

another of said key cap and said housing having two key stem guide sleeves for slidably receiving said two key stems, respectively;

each of said two key stems having a key stem axis;

each of said two key stem guide sleeves having a key stem guide sleeve axis;

said each of said two key stems being freely slidable in said respective key stem guide sleeve when said key stem axis of said each of said two key stems is within a certain acute angle from parallel with said respective key stem guide sleeve;

said each of said two key stems binding in said respective key stem guide sleeve when said key stem axis of said each of said two key stems is beyond said certain acute angle from parallel with said respective key stem guide sleeve;

said two key stem guide sleeve axes being substantially parallel; and said two key stem axes being out-of-parallel by no more than twice said certain acute angle.

10. Apparatus as in claim 9, wherein said two key stem axes meet in a direction of stroke relative to said key cap.

11. Apparatus as in claim 9, wherein said two key stem axes are form substantially identical and opposite angles with said two key stem guide sleeve axes.

* * * * *